US011618048B2

(12) United States Patent
Tawata et al.

(10) Patent No.: US 11,618,048 B2
(45) Date of Patent: Apr. 4, 2023

(54) PAINTING DEVICE

(71) Applicant: ABB Schweiz AG, Baden (CH)

(72) Inventors: Takahiro Tawata, Tokyo (JP); Kuniharu Yamauchi, Tokyo (JP); Jose Rodrigues, Shanghai (CN)

(73) Assignee: ABB SCHWEIZ AG, Baden (CH)

( * ) Notice: Subject to any disclaimer, the term of this patent is extended or adjusted under 35 U.S.C. 154(b) by 644 days.

(21) Appl. No.: 16/686,531

(22) Filed: Nov. 18, 2019

(65) Prior Publication Data

US 2020/0206764 A1 Jul. 2, 2020

Related U.S. Application Data

(63) Continuation of application No. PCT/JP2018/025625, filed on Jul. 6, 2018.

(51) Int. Cl.

| | |
|---|---|
| ***B05B 12/14*** | (2006.01) |
| ***B05B 15/55*** | (2018.01) |
| *B08B 9/032* | (2006.01) |

(52) U.S. Cl.

CPC ..... *B05B 12/1481* (2013.01); *B05B 15/55* (2018.02); *B08B 9/032* (2013.01)

(58) Field of Classification Search

CPC ..... B05B 15/55; B05B 12/1481

See application file for complete search history.

(56) References Cited

U.S. PATENT DOCUMENTS

| | | | | |
|---|---|---|---|---|
| 6,037,010 | A * | 3/2000 | Kahmann | B05B 12/1481 239/113 |
| 2002/0007788 | A1 | 1/2002 | Nonomura et al. | |
| 2004/0020428 | A1 * | 2/2004 | Bilz | B05B 5/1608 118/621 |

(Continued)

FOREIGN PATENT DOCUMENTS

| | | | |
|---|---|---|---|
| CN | 1593785 | A | 3/2005 |
| CN | 101300083 | A | 11/2008 |

(Continued)

OTHER PUBLICATIONS

Japan Patent Office, International Search Report & Written Opinion issued in corresponding Application No. PCT/JP2018/025625, dated Oct. 2, 2018, 12 pp.

(Continued)

*Primary Examiner* — Jason K Niesz

(74) *Attorney, Agent, or Firm* — Greenberg Traurig, LLP

(57) ABSTRACT

The present application is related to reducing the paint left inside the piping of the painting device. More specifically the present application is directed to a painting device that includes: a paint output part for outputting paint towards an object to be painted; a paint piping for the paint to pass through towards the paint output part; and a steel ball provided inside the paint piping; and a paint supply part supplying the paint to the paint piping from a side opposite to the paint output part. After the paint supply part stops supplying of the paint, the steel ball moves inside the paint piping towards the paint output part while the paint output part outputs the paint towards the object to be painted. The first moving fluid causes the steel ball to move inside the paint piping towards the paint output part by pushing the steel ball.

17 Claims, 9 Drawing Sheets

(56) References Cited

U.S. PATENT DOCUMENTS

| | | | | |
|---|---|---|---|---|
| 2004/0075848 | A1* | 4/2004 | Baumann | B05B 5/1608 356/622 |
| 2005/0092238 | A1 | 5/2005 | Ueno et al. | |
| 2008/0173236 | A1* | 7/2008 | Wojcik | F16L 55/46 118/302 |
| 2017/0066000 | A1* | 3/2017 | Schwab | B05B 15/58 |

FOREIGN PATENT DOCUMENTS

| | | | | |
|---|---|---|---|---|
| CN | 101628280 | A | | 1/2010 |
| CN | 103429355 | A | | 12/2013 |
| EP | 0888825 | A2 | | 1/1999 |
| EP | 1270083 | A1 | | 1/2003 |
| EP | 0904848 | B1 | | 4/2003 |
| JP | H04114459 | U | | 10/1992 |
| JP | H10165857 | A | | 6/1998 |
| JP | 2001047123 | A | * | 2/2001 |
| JP | 20011327897 | A | | 11/2001 |
| JP | 4945970 | B2 | | 6/2012 |
| JP | 2014161745 | A | | 9/2014 |
| JP | 2014188493 | A | | 10/2014 |

OTHER PUBLICATIONS

European Patent Office, Extended Search Report issued in corresponding Application No. 18835498.9, dated Mar. 19, 2021, 8 pp.
Chinese Patent Office, Office Action issued in corresponding Application No. 201880029546.6, dated Sep. 14, 2020, 18 pp.
Japanese Patent Office, Office Action issued in corresponding Application No. 2019-530962, dated Oct. 29, 2020, 13 pp.

* cited by examiner

PAINTING DEVICE

FIELD

The present invention relates to a painting device which performs painting while changing the color of a body of an automobile.

BACKGROUND

There is a known painting device which performs, painting while changing the color of the body of the automobile (referring to the abstract of the Patent Literature 1). Such a painting device is provided with a piping for the paint to pass through.

EXISTING TECHNOLOGY LITERATURE

Patent Literate

Patent Literature 1: JP2004-344899

SUMMARY

In such a piping, it is not preferable to leave the paint prior to color changing.

Accordingly, the present invention aims at how to reduce the paint residual inside the piping of the painting device.

The painting device according to the present, invention comprises: a paint output part for outputting paint towards an object to be painted; a paint piping for the paint to pass through towards the paint output part; and a movable body provided inside the paint piping, the movable body moving inside the paint piping towards the paint output part, while the paint output part is outputting the paint towards the object to be painted.

In accordance with the painting device of the present invention, the paint output part outputs the paint to towards the object to be painted and the paint piping is provided for the paint to pass towards the paint output part. The movable body is disposed inside the paint piping. While the paint output part is outputting the paint towards the object to be painted, the movable body moves inside the paint piping towards the paint output part.

In addition, the painting device according to the present invention further comprises a paint supply part for supplying the paint to the paint piping, the movable body moving inside the paint piping towards the paint output part after the paint supply part stops supplying the paint.

In addition, in the painting device according to the present invention, while the paint output part stops outputting the paint towards the object to be painted, the movable body moves inside the paint piping towards a side opposite to the paint output part.

In addition, in the painting device according to the present invention, the movable body is disposed at an end of the paint piping adjacent to the paint supply part, while the paint supply part is supplying the paint.

In addition, the painting device according to the present invention further comprises a stop for preventing a movement of the movable body from an end of the paint piping adjacent to the paint supply part.

In addition, the painting device according to the present invention further comprises a supply valve for first moving fluid for switching on or off supply of first moving fluid to an end of the paint piping adjacent to the paint supply part, the first moving fluid causing the movable body to move inside the paint piping towards the paint output part by pushing the movable body; wherein the paint supply part is provided with a gear pump, and wherein the supply valve for first moving fluid is disposed at a side opposite to the paint piping seen from the gear pump.

In addition, the painting device according to the present invention further comprises a plurality of first supply valves for moving fluid for switching on or off supply of first moving fluid to an end of the paint piping adjacent to the paint supply part, the first moving fluid causing the movable body to move inside the paint piping towards the paint output part by pushing the movable body, wherein the paint supply part is provided with a gear pump, and wherein the first supply valves for moving fluid are disposed at a side opposite to the paint piping and at a same side with the paint piping seen from the gear pump.

In addition, in the painting device according to the present invention, while the paint output part stops outputting the paint towards the object to be painted, the movable body moves from an end of the paint piping adjacent to the paint output part towards an end at a side opposite to the paint output part.

In addition, the painting device according to the present invention further comprises a supply valve for second moving fluid for switching on or off supply of second moving fluid to an end of the paint piping adjacent to the paint output part, the second moving fluid causing the movable body to move inside the paint piping towards a side opposite to the paint output part by pushing the movable body; the supply valve for second moving fluid being disposed at an end of the paint piping adjacent to the paint output part.

In addition, the painting device according to the present invention further comprises a supply valve for second moving fluid for switching on or off supply of second moving fluid to an end of the paint piping adjacent to the paint output part, the second moving fluid causing the movable body to move inside the paint piping towards a side opposite to the paint output part by pushing the movable body; the supply valve for second moving fluid being disposed inside the paint output part.

In addition, the painting device according to the present invention further comprises a sensor for detecting a position of the movable body.

In addition, in the painting device according to the present invention, the movable body is a steel ball.

In addition, the painting device according to the present invention further comprises a groove for the paint to pass through, the groove being disposed at an end of the paint piping adjacent to the paint output part.

In addition, the painting device according to the present invention further comprises a groove for the paint to pass through, the groove being disposed at an end of the paint piping adjacent to the paint supply part.

DETAILED DESCRIPTION OF EMBODIMENTS

Embodiments of the present invention are illustrated hereinafter with reference to the drawings.

First Embodiment

Figure 1:
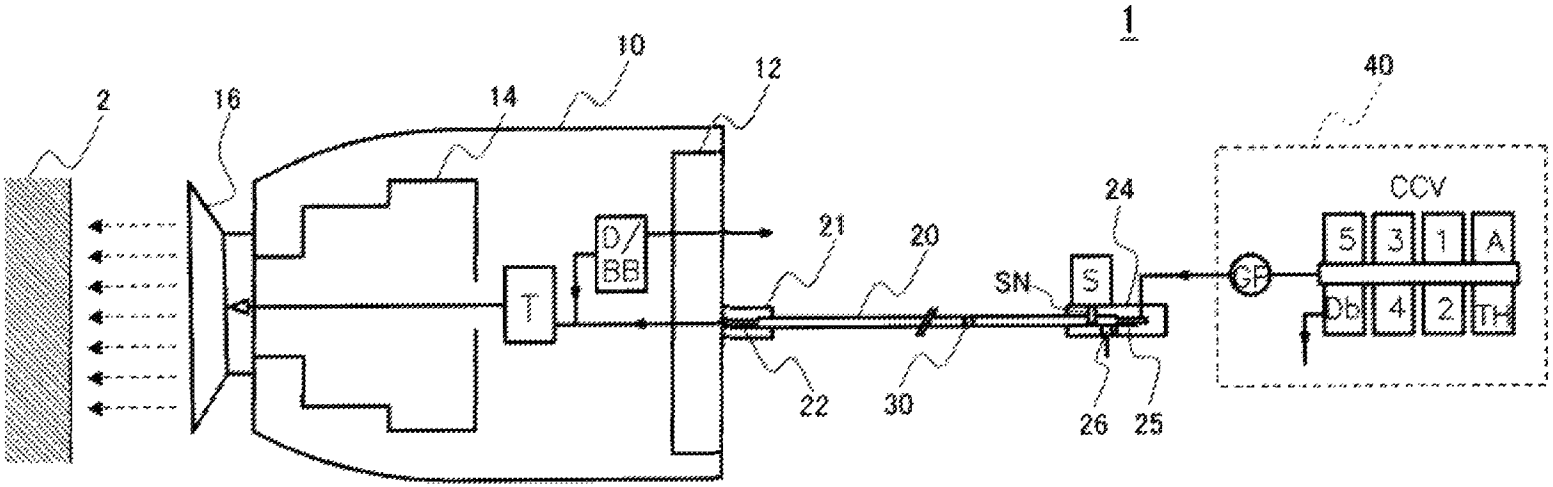
FIG. 1 is a front section view of the painting, device 1 in accordance with a first embodiment of the present invention.

FIG. 1 is a front section view of the painting device 1 in accordance with a first embodiment of the present invention. The painting device 1 of the first embodiment includes a paint output part 10, a paint piping 20, a magnetic sensor 26, a steel ball (movable body) 30 and a paint supply part 40.

The paint output part 10 outputs the paint towards an object to be painted 2, which for example is a body of the automobile. The paint output part 10 has a back plate 12, a pneumatic motor 14, a bell cup 16, a trigger valve T, and a supply valve for second moving fluid BB.

The back plate 12 is a plate disposed at the rear (a side opposite to the bell cup 16) of the paint output part 10. The pneumatic motor 14 causes the bell cup 16 to rotate at a high speed (e.g., 3000-150000 rpm) by means of the compressed air. Besides, the paint provided from the paint piping 20 to the paint output part 10 passes through the back plate 12 and the trigger valve T and then is provided to the bell cup 16 along a rotational shaft of the pneumatic motor 14. The bell cup 16 rotates at a high speed to atomize the provided paint. The atomized paint is painted towards the object to be painted 2.

The trigger valve V is a valve for switching on or off the supply of the fluid (e.g., paint) which is provided from the paint piping 20 to the paint output part 10, towards the pneumatic motor 14. The supply valve for second moving fluid. BB is a valve for switching on or off the supply of a second moving fluid Th2 (see FIG. 5) towards an end of the paint piping 20 adjacent to the paint output part 10, i.e., an output-side end 21, wherein the second moving fluid Th2 (such as diluent) is used for pushing the steel ball (movable body) 30 to cause the steel ball 30 to move inside the paint piping 20 towards a side opposite to the paint output part 10.

The supply valve for second moving fluid BB is disposed inside the paint output part 10 and it is further disposed in a piping which is branched, between the trigger valve V and the output-side end 21, from the piping inside the paint output part 10 for connecting the trigger valve T and the output-side end 21. In addition, the supply valve for second moving fluid BB also serves as a dump valve D for discharging liquid waste generated during the cleaning the interior of the paint piping 20.

The paint piping 20, e.g., resin pipe, is a piping for the paint to pass towards the paint output part 10. Besides, as the paint piping 20 is quite long in FIG. 1, the details in the middle part are omitted and the components adjacent to both ends of the paint piping 20 are illustrated (which is also the same case in other figures).

The steel ball (movable body) 30 is disposed within and movable in the paint piping 20. Although the description specifies the movable body as "steel ball 30," the movable body is not necessarily made of steel or spherical, as long as it can move inside the paint piping 20.

The magnetic sensor 26 detects the position of the steel ball (movable body) 30 and is disposed at a supply-side end 24 of the paint piping 20. Whether the steel ball 30 is at the supply-side end 24 can be determined by means of the magnetic sensor 26. Moreover, instead of being disposed at the supply-side end 24 only, the magnetic sensor 26 may also be disposed at the output-side end 21. In this case, the magnetic sensor can determine whether the steel ball 30 is at the output-side end 21. Additionally, an optical sensor may also be disposed in place of the magnetic sensor 26. That is, any sensor (e.g., proximity sensor) may replace the magnetic sensor 26 as long as the sensor can determine whether the steel ball 30 is positioned at the supply-side end 24 or the output-side end 21.

The paint supply part 40 supplies the paint to the paint piping 20 from a side opposite to the paint output part 10.

The paint supply part 40 includes a Gear Pump GP, a Color Change Valve CCV and a paint can (omitted in the drawings).

The Color Change Valve CCV comprises paint valves 1-5, an air valve A, a steel ball side dump valve Db and a supply valve for first moving fluid TH.

The paint valve 1, connected with a paint can which contains the paint of a certain color (e.g., red), is a valve for switching on or off the supply of the paint of the certain color to the Gear Pump GP. The paint valves 2-5 are the same as the paint valve 1. However, the paint valves 1-5 are connected with paint cans of different colors, respectively.

The air valve A is a valve for switching on or off the supply of the compressed air to the paint piping 20. Besides, the air valve A is connected with an air compressor, which is not shown in the figures. The steel ball side dump valve Db is a valve for switching on or off the discharge of the liquid waste inside the paint piping 20.

The supply valve for first moving fluid TH is a valve for switching on or off the supply of a first moving fluid Th1 (see FIG. 3) to the supply-side end 24 of the paint piping 20 adjacent to the paint supply part 40. In addition, the first moving fluid Th1 (such as diluent) is used for pushing the steel ball (movable body) 30 to cause the steel ball 30 to move inside the paint piping 20 towards the paint output part 10. Moreover, the supply valve for first moving fluid TH is disposed at a side opposite to the paint piping 20 seen from the Gear Pump GP.

The Gear Pump GP is a gear pump which receives the paint from the paint valves 1-5 and pressurizes the paint to deliver to the supply-side end 24. In addition, the Gear Pump GP receives and pressurizes the first moving fluid Th1 from the supply valve for first moving fluid TH and further delivers the first moving fluid Th1 to the supply-side end 24.

Additionally, the supply-side end 24 is an end of the paint piping 20 adjacent to the paint supply part 40.

Next, acts of the first embodiment are explained.

Acts of the first embodiment includes four phases. i.e., (Process 1) painting (based on the paint supplied via the Color Change Valve CCV). (Process 2) painting (based on the paint left inside the paint piping 20), (Process 3) stop painting (the steel ball 30 returns to the supply-side end 24) and (Process 4) cleaning inside the paint piping 20. (Process 1)-(Process 4) are described hereinafter.

(Process 1) Painting (Based on the Paint Supplied by the Color Change Valve CCV)

Figure 2:
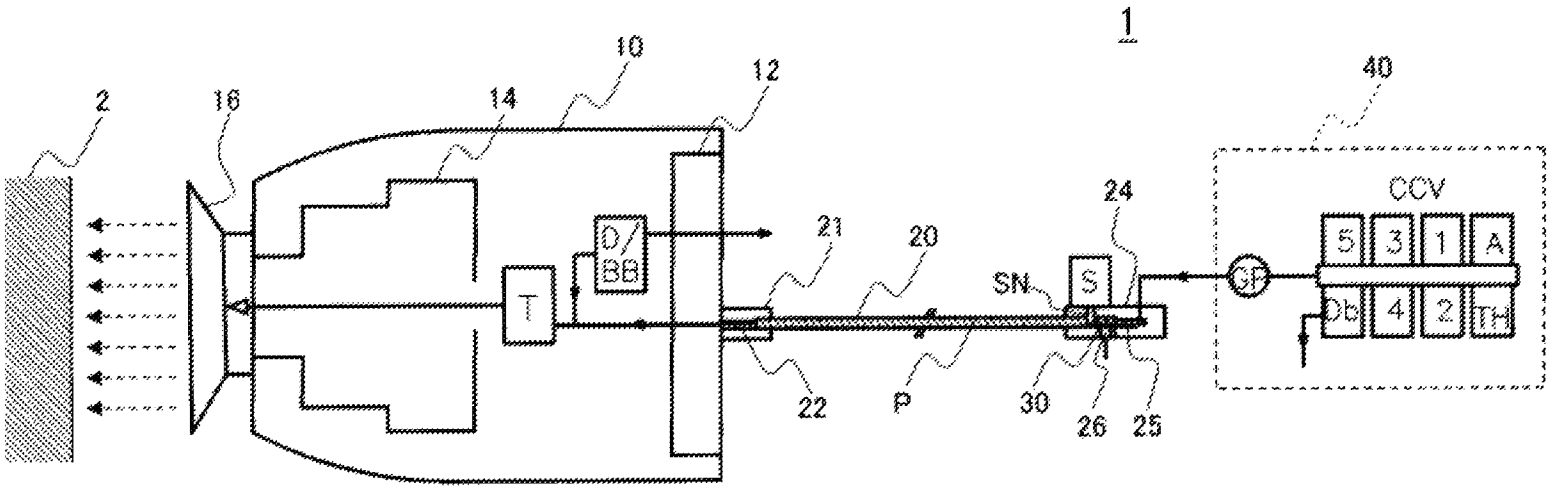
FIG. 2 is a front section view of the painting device 1 in accordance with the first embodiment of the present invention during the painting (based on the paint supplied via the Color Change Valve CCV).

FIG. 2 is a front section view of the painting device 1 in accordance with the first embodiment of the present invention during the painting (based on the paint supplied by the Color Change Valve CCV).

The paint supply part 40 carries out the supply the paint P. That is, starting from the paint can (omitted in the drawings) of the paint supply part 40, the paint P is supplied from an end at a side opposite to the paint output part 10, i.e., supply-side end 24 to the paint piping 20 via the opened paint valve 1 and the Gear Pump GP. The paint piping 20 is filled with the paint P.

The paint P is output towards the object to be painted 2 from the paint output part 10 though the paint piping 20. The object to be painted 2 is painted with the paint P accordingly.

During the supply of the paint P by the paint supply part 40, the steel ball 30 is disposed at the supply-side end 24 of the paint piping 20 adjacent to the paint supply part 40. In addition, the steel ball 30 tends to move from the supply-side end 24 to the paint output part 10 along with the flow of the paint P. However, the steel ball 30 is blocked by a pin (stop) SN protruding into the paint piping 20 to avoid the movement of the steel ball 30 from the supply-side end 24. Besides, the painting device 1 is provided with a ball stopping valve S which determines whether the pin SN protrudes into the paint piping 20 or not.

Furthermore, a groove (omitted in the drawings) is disposed at the supply-side end 24 and the paint P may flow from the groove to the downstream side of the steel ball 30 (side of the paint output part 10). The same groove enabling the flow of the paint P may also be arranged at the output-side end 21. As such, the groove may be disposed only at the supply-side end 24, or only at the output-side end 21 or at both ends 24, 21. Moreover, it is also possible that the groove is disposed at neither the supply-side end 24 nor the output-side end 21.

Here, in order to switch to the painting based on other colors (e.g., color of the paint contained the paint can which is connected to the paint valve 2), the paint valve 1 is switched off to stop the supply of the paint P by the paint supply part 40. In this way, the paint P would be left inside the paint piping 20. If the paint of other colors is supplied into the paint piping 20 when the paint P is left, the left paint would be mixed with the supplied paints and the painting based on unintentional colors will occur. Therefore, it is required to reduce residuals of the paint P inside the paint piping 20.

(Process 2) Painting (Based on the Paint Residual Inside the Paint Piping 20)

Figure 3:
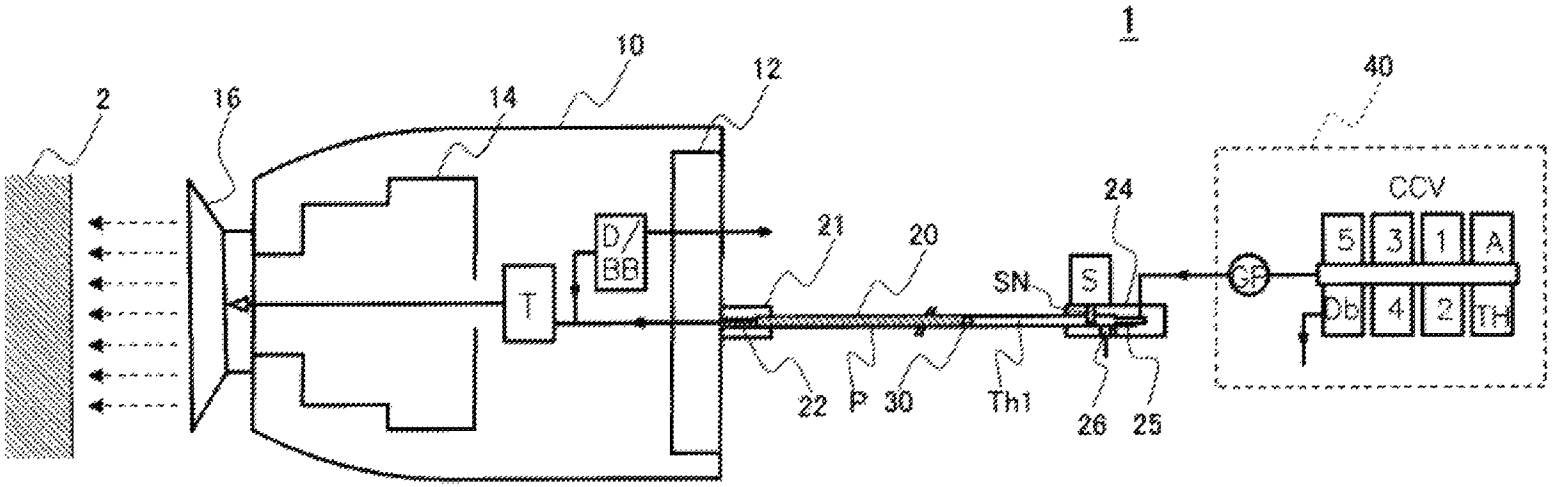
FIG. 3 is a front section view of the painting device 1 in accordance with the first embodiment of the present invention during the painting (based on the paint left inside the paint piping 20).

FIG. 3 is a front section view of the painting device 1 in accordance with the first embodiment of the present invention during the painting (based on the paint left inside the paint piping 20).

When the (Process 1) is finished, i.e., after the paint supply part 40 stops supplying the paint P, the pin (stop) SN protruding into the paint piping 20 is retracted simultaneously while the closed supply valve for first moving fluid TH is opened. In this way, the first moving fluid Th1 is supplied, via the supply valve for first moving fluid TH, and the Gear Pump GP, to the paint piping 20 from the supply-side end 24 opposite to the paint output part 10. The first moving fluid Th1 pushes the steel ball 30 to cause the steel ball to move inside the paint piping 20 towards the paint output part 10.

When the steel ball 30 moves inside the paint piping 20 towards the paint output part 10, the residual of the paint P in the paint piping 20 is pushed towards the paint output part 10. Accordingly, the paint P left in the paint piping 20 is discharged from the paint piping 20 and, arrives at the paint output part 10, from which the paint P left is output towards the object to be painted 2. Therefore, the painting based on the paint P also continues in the (Process 2).

In other words, when the paint output part 10 is outputting the paint P towards the object to be painted 2 during the (Process 2), the steel ball (movable body) 30 moves inside the paint piping 20 towards the paint output part 10.

Finally, the steel ball 30 arrives at the output-side end 21 of the paint piping 20 adjacent to the paint output part 10. The output-side end 21 is provided with a portion having an inner diameter smaller than that of the paint piping 20, i.e., a small-diameter portion 22. The steel ball 30 collides on an end face of the small-diameter portion 22 and then comes to a stop.

Figure 4:
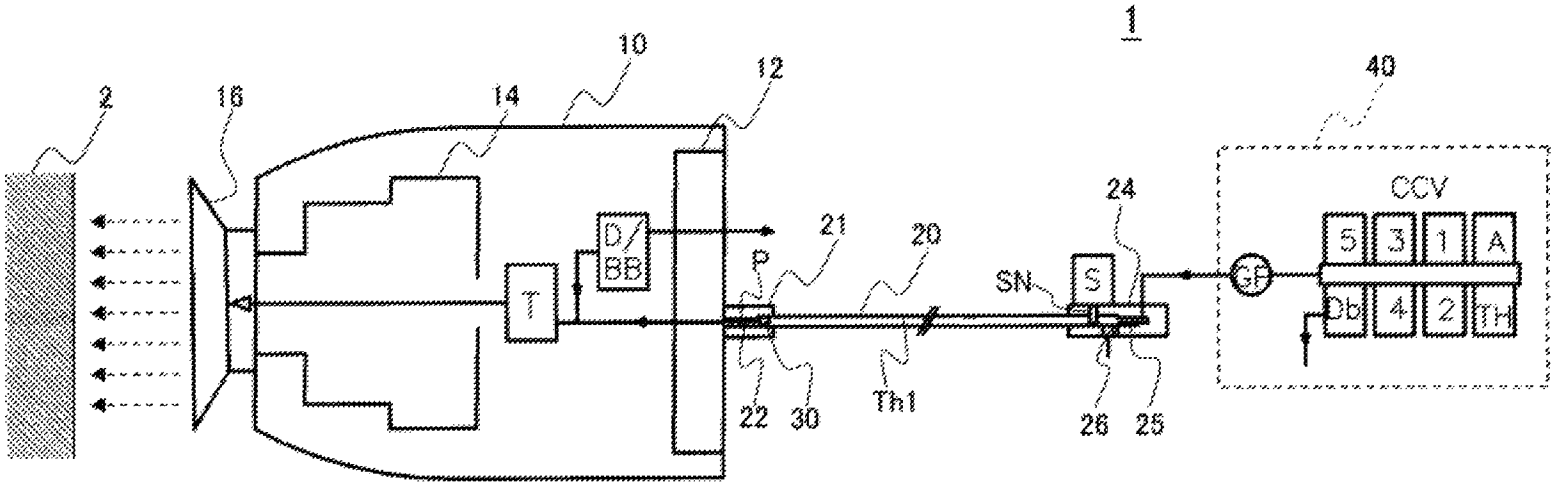
FIG. 4 is a front section view of the painting device 1 in accordance with the first embodiment of the present invention when the steel ball 30 arrives at the output-side end 21 during the painting (based on the paint left inside the paint piping 20).

FIG. 4 is a front section view of the painting device 1 in accordance with the first embodiment of the present invention when the steel ball 30 arrives at the output-side end 21 during the painting (based on the paint residual inside the paint piping 20). When the steel ball 30 has arrived at the output-side end 21 for a given period of time, the opened trigger valve T is closed and the paint output part 10 stops outputting the paint P towards the object to be painted 2 (i.e., painting).

(Process 3) Stop Painting (The Steel Ball 30 Returns to the Supply-Side End 24)

Figure 5:
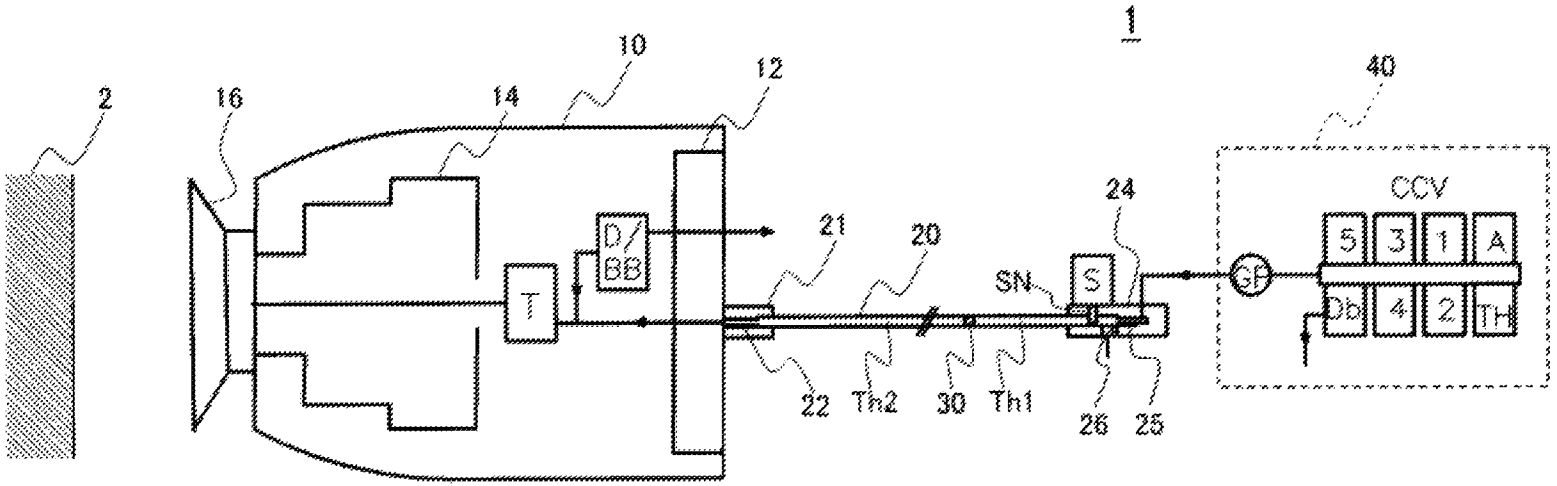
FIG. 5 is a front section view of the painting device 1 in accordance with the first embodiment of the present invention when the painting stops (the steel ball 30 returns to the supply-side end 24).

FIG. 5 is a front section view of the painting device 1 in accordance with the first embodiment of the present invention when the painting stops (the steel ball 30 returns to the supply-side end 24).

At the time point when the (Process 2) finishes, the paint output part 10 stops outputting the paint towards the object to be painted 2. At this moment, if the closed supply valve for second moving fluid BB is opened, the second moving fluid Th2 is provided to the output-side end 21 via the supply valve for second moving fluid BB. When the second moving fluid Th2 pushes the steel ball (movable body) 30 to enable the steel ball 30 arriving at the output-side end 21 to move inside the paint piping 20 towards the side opposite to the paint output part 10, the steel ball 30 moves towards the supply-side end 24. Besides, the supply-side end 24 can be an end of the paint piping 20 at a side opposite to the paint output part 10.

Here, the closed steel ball side dump valve Db is opened to discharge the first moving liquid Th1 and the second moving fluid Th2. The second moving fluid Th2 reaches the steel ball side dump valve Db via the slot (omitted in the drawings) arranged at the supply-side end 24.

Finally, the steel ball 30 reaches the supply-side end 24 of the paint piping 20. The supply-side end 24 is provided with a portion having an inner diameter smaller than that of the paint piping 20, i.e., a small-diameter portion 25. The steel ball 30 collides on an end face of the small-diameter portion 25 and then comes to a stop.

When the steel ball 30 returns to the supply-side end 24, the magnetic sensor 26 detects this situation. The steel ball which stops valve S causes the pin SN to protrude into the paint piping 20 based on the detection. At this time point, (Process 3) is finished.

(Process 4) Cleaning Inside the Paint Piping 20

After (Process 3) is finished, the air valve A and the supply valve for first moving fluid TH are opened alternately to clean the inside of the paint piping 20. At this moment, the dump valve D or the trigger valve T is pre-opened to discharge the waste liquid generated during the cleaning of the paint piping 20.

When (Process 4) is finished, the paint valve 2 is opened in place of the paint valve and the procedure returns to the paint based on other colors (Process).

In accordance with the first embodiment, by causing the steel ball 30 to move inside the paint piping 20 towards the paint output pan 10, the paint P left within the paint piping 20 can be output (painted) towards the object to be painted 2 via the paint output part 10. Therefore, the amount of paint P left in the paint piping 20 of the painting device 1 can be reduced.

Second Embodiment

The second embodiment is different from the painting device 1 in accordance with the first embodiment in that, the steel ball side dump valve Db is disposed at the supply-side end 24 and the supply valve for second moving fluid BB is disposed at the output-side end 21.

Figure 6:
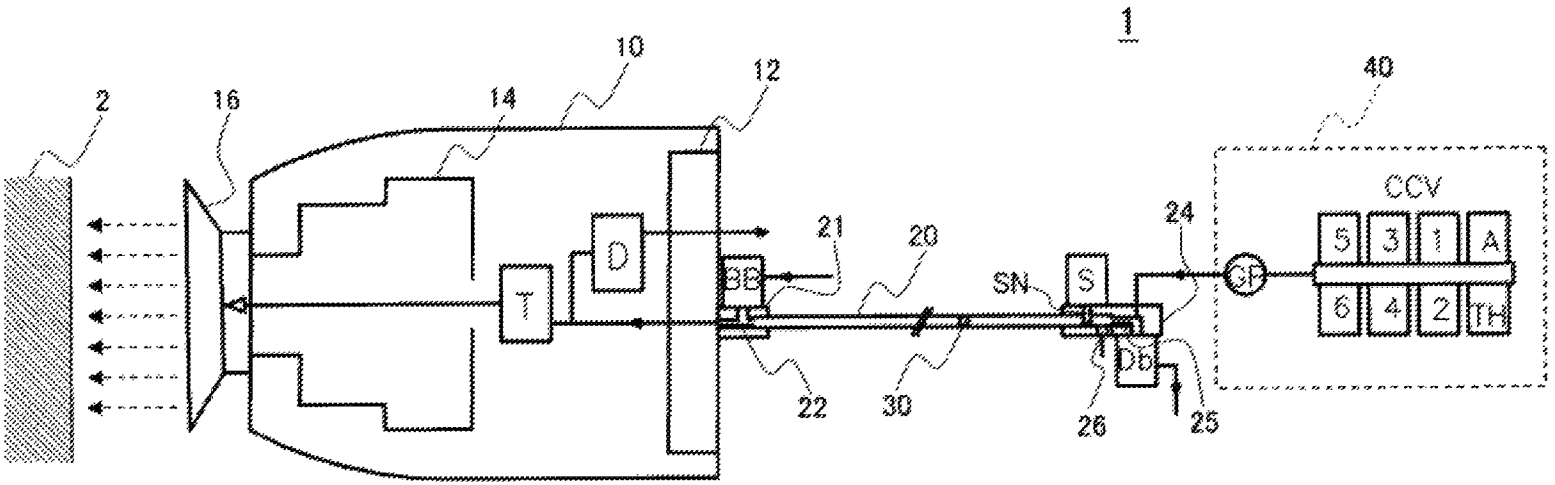
FIG. 6 is a front section view of the painting device 1 in accordance with the second embodiment of the present invention.

FIG. 6 is a front section view of the painting device 1 in accordance with the second, embodiment of the present invention. The painting device 1 of the second embodiment includes a paint output part 10, a paint piping 20, a magnetic sensor 26, a steel ball (movable body) 30 and a paint supply part 40. The components identical to the first embodiment are labeled with the same reference signs and the descriptions thereof are omitted below.

The paint output part 10 is the same as in the first embodiment. Different from the first embodiment, the dump valve D does not serve as the supply valve for second moving fluid BB simultaneously in the second embodiment.

The paint piping 20, the magnetic sensor 26 and the steel ball 30 are the same as in the first embodiment and the descriptions thereof are omitted.

The supply valve for second moving fluid BB is disposed at the output-side end 21 and the steel ball dump valve Db is disposed at the supply-side end 24.

Different from the first embodiment, the paint supply part 40 in the second embodiment includes a paint valve 6 in place of the steel side dump valve Db. The rest, features of the paint supply part 40 are identical to those in the first embodiment.

Acts in the second embodiment are the same as those in the first embodiment.

The second embodiment can achieve the same effects as the first embodiment.

As a modification of the second embodiment, the supply valve for first moving fluid Tb may be added at the same side with the paint piping 20 seen from the Gear Pump GP.

Figure 7:
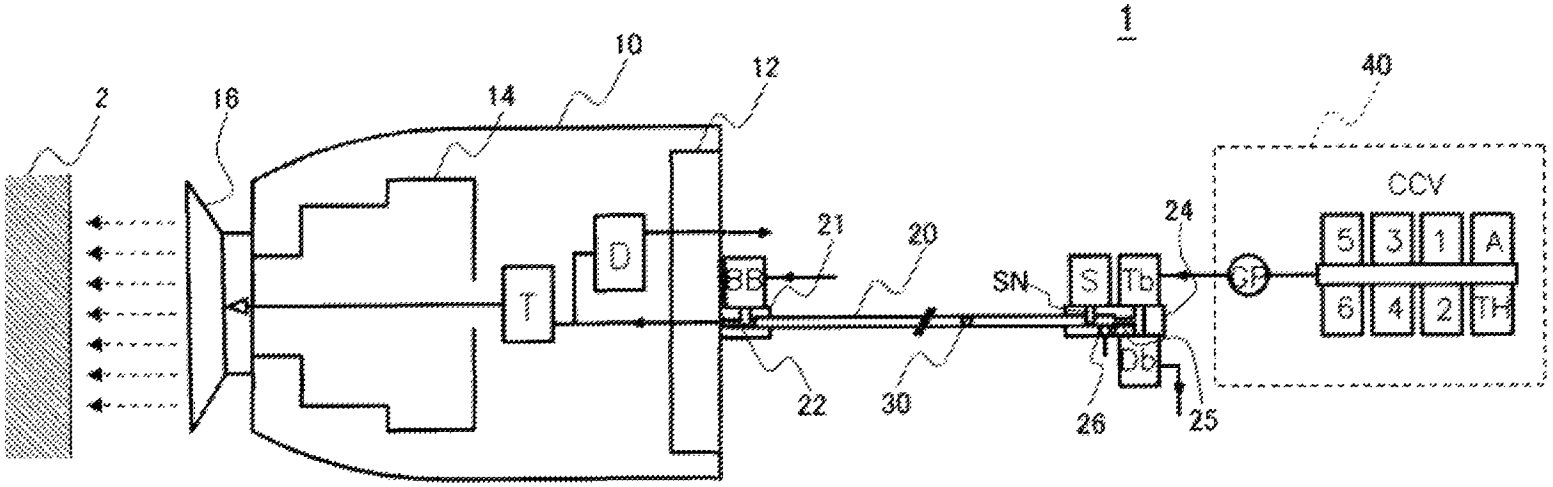
FIG. 7 is a front section view of the painting device 1 in accordance with a modification of the second embodiment.

FIG. 7 is a front section view of the painting device 1 in accordance with the modification of the second embodiment. In addition to the supply valve for first moving fluid TH, a further supply valve for first moving fluid Tb is also provided for switching on or off the supply of the first moving fluid Th1 to the supply-side end 24 of the paint piping 20 adjacent to the paint supply part 40.

The supply valve for first moving fluid Tb is disposed at the same side with the paint piping 20 seen from the Gear Pump GP. For example, the supply valve for first moving fluid. Tb is disposed at the supply-side end 24. In addition, the supply valve for first moving fluid Tb is opened in Processes 1 and 2.

Third Embodiment

The third embodiment is different from the painting device 1 in accordance with the first embodiment in that, the steel ball side dump valve Db is disposed at the supply-side end 24 and the dump valve D is not included.

Figure 8:
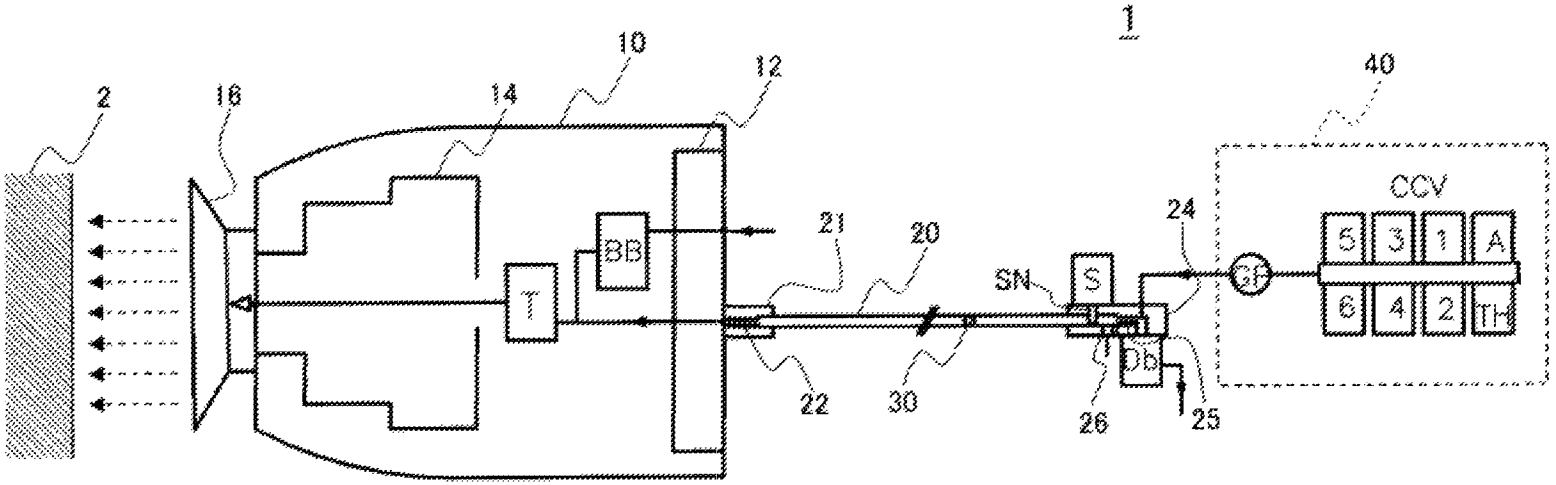
FIG. 8 is a front section view of the painting device 1 in accordance with the third embodiment.

FIG. 8 is a front section view of the painting device 1 in accordance with the variant of the third embodiment. The painting device 1 of the third embodiment includes a paint output part 10, a paint piping 20, a magnetic sensor 26, a steel ball (movable body) 30 and a paint supply part 40. The components identical to the first embodiment are labeled with the same reference signs and the explanations thereof are omitted below.

The paint output part 10 is the same as in the first embodiment. Different from the first embodiment, the supply valve for second moving fluid BB does not serve as the dump valve D simultaneously in the third embodiment. In fact, the painting device 1 of the third embodiment does not comprise the dump valve D.

The paint piping 20, the magnetic sensor 26 and the steel ball 30 are the same as in the first embodiment and the descriptions thereof are omitted.

The steel ball side dump valve Db is disposed at the supply-side end 24.

Different from the first embodiment, the paint supply part 40 in the third embodiment includes a paint valve 6 in place of the steel side dump valve Db. The rest features of the paint supply part 40 are identical to those the first embodiment.

Acts in the third embodiment are the same as those in the first embodiment.

The third embodiment can achieve the same effects as the first embodiment.

As a modification of the third embodiment, the supply valve for first moving fluid Tb may be added at the same side with the paint piping 20 seen from the Gear Pump GP.

Figure 9:
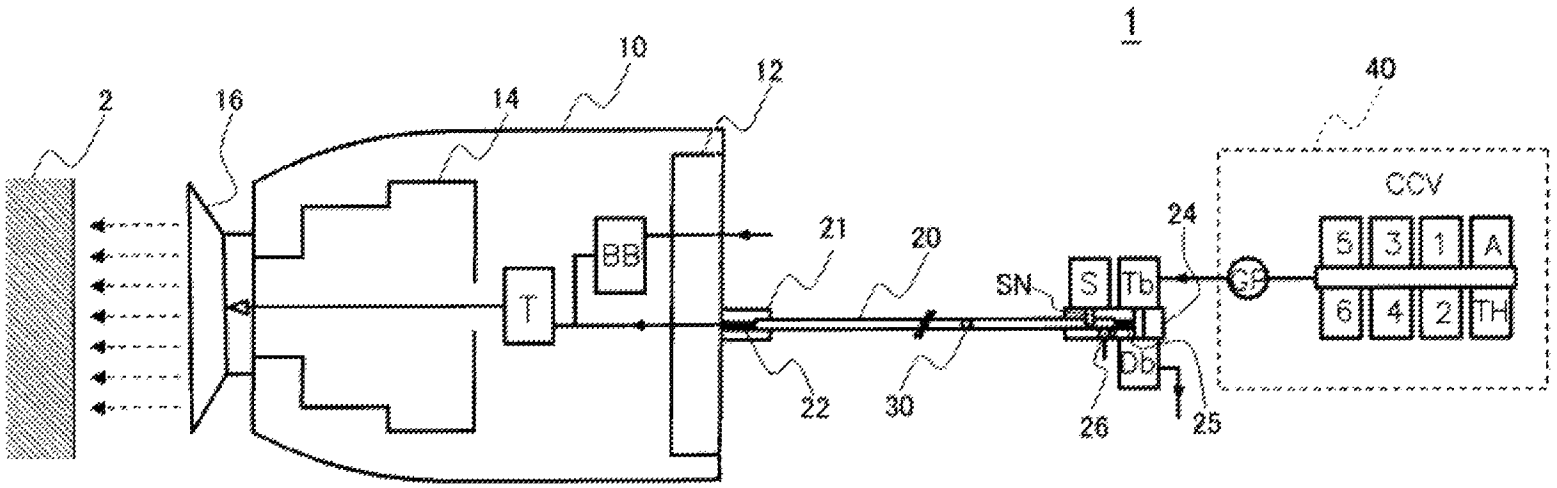
FIG. 9 is a front section view of the painting device 1 in accordance with a modification of the third embodiment.

FIG. 9 is a front section view of the painting device 1 in accordance with the modification of the third embodiment. In addition to the supply valve for first moving fluid TH, a further supply valve for first moving fluid Tb is also provided for switching on or off the supply of the first moving fluid Th1 to the supply-side end 24 of the paint piping 20 adjacent to the paint supply part 40.

The supply valve for first moving fluid Tb is disposed at the same side with the paint piping 20 seen from the Gear Pump GP. For example, the supply valve for first moving fluid Tb is disposed at the supply-side end 24. In addition, the supply valve for first moving fluid Tb is opened in Processes 1 and 2.

DESCRIPTION OF REFERENCE SIGNS

1 Painting device
2 Object to be painted
10 Paint output part
12 Back plate
14 Pneumatic motor
16 Bell cup
20 Paint piping
21 Output-side end
22 Small-diameter portion
24 Supply-side end

25 Small-diameter portion
26 Magnetic sensor
30 Steel ball (movable body)
40 Paint supply part
1-5 Paint valve
T Trigger valve
D Dump vale
TH, Tb Supply valve for first moving fluid
BB Supply valve for second moving fluid
GP Gear Pump
CCV Color Change Valve
A Air valve
Db Steel side dump valve
P Paint
Th1 First moving fluid
Th2 Second moving fluid

We claim:

1. A painting device, comprising:

a paint output part for outputting paint towards an object to be painted;

a paint piping for the paint to pass through towards the paint output part; and a movable body provided inside the paint piping, the movable body moving inside the paint piping towards the paint output part, while the paint output part is outputting the paint towards the object to be painted, the paint piping having a groove for the paint to pass through;

wherein the groove is disposed at an end of the paint piping adjacent to the paint output part.

2. The painting device of claim 1, further comprising: a sensor for detecting a position of the movable body.

3. The painting device of claim 1, wherein the movable body is a steel ball.

4. The painting device of claim 1, wherein while the paint output part stops outputting the paint towards the object to be painted, the movable body moves inside the paint piping towards a side opposite to the paint output part.

5. The painting device of claim 4, wherein while the paint output part stops outputting the paint towards the object to be painted, the movable body moves from an end of the paint piping adjacent to the paint output part towards an end at a side opposite to the paint output part.

6. The painting device of claim 4, further comprising: a supply valve for second moving fluid, for switching on or off supply of second moving fluid to an end of the paint piping adjacent to the paint output part, the second moving fluid causing the movable body to move inside the paint piping towards a side opposite to the paint output part by pushing the movable body, the supply valve for second moving fluid being disposed at an end of the paint piping adjacent to the paint output part.

7. The painting device of claim 4, further comprising: a supply valve for second moving fluid for switching on or off supply of second moving fluid to an end of the paint piping adjacent to the paint output part, the second moving fluid causing the movable body to move inside the paint piping towards a side opposite to the paint output part by pushing the movable body, the supply valve for second moving fluid being disposed inside the paint output part.

8. The painting device of claim 1, comprising: a paint supply part for supplying the paint to the paint piping, the movable body moving inside the paint piping towards the paint output part after the paint supply part stops supplying the paint.

9. The painting device of claim 8, further comprising: a supply valve for first moving fluid, for switching on or off supply of first moving fluid to an end of the paint piping adjacent to the paint supply part, the first moving fluid causing the movable body to move inside the paint piping towards the paint output part by pushing the movable body, the paint supply part being provided with a gear pump, and the supply valve for first moving fluid being disposed at a side opposite to the paint piping seen from the gear pump.

10. The painting device of claim 8, further comprising, a plurality of first supply valves for moving fluid for switching on or off supply of first moving fluid to an end of the paint piping adjacent to the paint supply part, the first moving fluid causing the movable body to move inside the paint piping towards the paint output part by pushing the movable body; the paint supply part being provided with a gear pump, and the first supply valves for moving fluid being disposed at a side opposite to the paint piping and at a same side with the paint piping seen from the gear pump.

11. The painting device of claim 8, wherein the groove is disposed at an end of the paint piping adjacent to the paint supply part.

12. The painting device of claim 8, wherein the movable body is disposed at an end of the paint piping adjacent to the paint supply part, while the paint supply part is supplying the paint.

13. The painting device of claim 12, further comprising: a stop for preventing a movement of the movable body from an end of the paint piping adjacent to the paint supply part.

14. The painting device of claim 8, wherein while the paint output part stops outputting the paint towards the object to be painted, the movable body moves inside the paint piping towards a side opposite to the paint output part.

15. The painting device of claim 14, wherein while the paint output part stops outputting the paint towards the object to be painted, the movable body moves from an end of the paint piping adjacent to the paint output part towards an end at a side opposite to the paint output part.

16. A painting device, comprising:

a paint output part for outputting paint towards an object to be painted;

a paint piping for the paint to pass through towards the paint output part;

a movable body provided inside the paint piping, the movable body moving inside the paint piping towards the paint output part, while the paint output part is outputting the paint towards the object to be painted;

a paint supply part for supplying the paint to the paint piping, the movable body moving inside the paint piping towards the paint output part after the paint supply part stops supplying the paint, wherein while the paint output part stops outputting the paint towards the object to be painted, the movable body moves inside the paint piping towards a side opposite to the paint output part; and a supply valve for second moving fluid, for switching on or off supply of second moving fluid to an end of the paint piping adjacent to the paint output part, the second moving fluid causing the movable body to move inside the paint piping towards a side opposite to the paint output part by pushing the movable body, the supply valve for second moving fluid being disposed at an end of the paint piping adjacent to the paint output part.

17. A painting device, comprising:

a paint output part for outputting paint towards an object to be painted;

a paint piping for the paint to pass through towards the paint output part;

a movable body provided inside the paint piping, the movable body moving inside the paint piping towards the paint output part, while the paint output part is outputting the paint towards the object to be painted;

a paint supply part for supplying the paint to the paint piping, the movable body moving inside the paint piping towards the paint output part after the paint supply part stops supplying the paint, wherein while the paint output part stops outputting the paint towards the object to be painted, the movable body moves inside the paint piping towards a side opposite to the paint output part; and a supply valve for second moving fluid for switching on or off supply of second moving fluid to an end of the paint piping adjacent to the paint output part, the second moving fluid causing the movable body to move inside the paint piping towards a side opposite to the paint output part by pushing the movable body, the supply valve for second moving fluid being disposed inside the paint output part.

* * * * *